US008225970B2

(12) United States Patent
Ventrola

(10) Patent No.: US 8,225,970 B2
(45) Date of Patent: Jul. 24, 2012

(54) INFANT CARRIER BUCKLE

(75) Inventor: Todd Ventrola, Liberty Township, OH (US)

(73) Assignee: Evenflo Company, Inc., Miamisburg, OH (US)

( * ) Notice: Subject to any disclaimer, the term of this patent is extended or adjusted under 35 U.S.C. 154(b) by 379 days.

(21) Appl. No.: 12/696,649

(22) Filed: Jan. 29, 2010

(65) Prior Publication Data

US 2011/0186604 A1 Aug. 4, 2011

(51) Int. Cl.
*A44B 11/26* (2006.01)
*A47D 13/02* (2006.01)

(52) U.S. Cl. ..... 224/158; 24/318; 24/606

(58) Field of Classification Search ..... 224/158–161; 24/165, 192, 265 H, 318, 319, 343, 578.14, 24/578.15, 582.1, 592.1, 592.11, 598.1, 598.4, 24/614

See application file for complete search history.

(56) References Cited

U.S. PATENT DOCUMENTS

| | | | | |
|---|---|---|---|---|
| 330,152 | A | 11/1885 | Rammoser | |
| 417,124 | A | 12/1889 | Walker | |
| 429,089 | A | 5/1890 | Esser | |
| 1,531,757 | A | 3/1925 | Rogers, Jr. | |
| 5,313,691 | A | 5/1994 | Hashimoto | |
| 5,711,056 | A | 1/1998 | Taguchi et al. | |
| 5,970,588 | A | 10/1999 | Hurtz et al. | |
| 6,557,220 | B1 | 5/2003 | Hamm, Jr. | |
| 6,802,109 | B2 * | 10/2004 | Petzl et al. | 24/318 |
| 7,007,353 | B2 | 3/2006 | Bergkvist | |
| 7,070,076 | B2 * | 7/2006 | Bergkvist | 224/160 |
| 7,204,002 | B2 * | 4/2007 | Kaneko et al. | 24/614 |

* cited by examiner

*Primary Examiner* — Justin Larson
*Assistant Examiner* — Adam Waggenspack
(74) *Attorney, Agent, or Firm* — Taft, Stettinius & Hollister LLP

(57) ABSTRACT

Buckles for releasably connecting a first object and a second object. Example buckles may include a base including a first upstanding wall including a first boss extending therefrom and a second upstanding wall including a second boss extending therefrom. A housing may be mounted to a connector. The housing may include a hook section shaped to engage the first boss and the second boss and including a mouth for receiving the first boss and the second boss therethrough. A trigger may be configured to selectively obstruct the mouth. The trigger may include a first leg, a second leg, and one or more actuators operative to move the first leg and the second leg generally towards each other such that the first leg and the second leg may pass between the first boss and the second boss as the first boss and the second boss pass through the mouth.

19 Claims, 8 Drawing Sheets

INFANT CARRIER BUCKLE

BACKGROUND

The present disclosure is directed to buckles and to infant carriers incorporating buckles.

The following U.S. patents may include disclosure relevant to buckles and/or infant carriers and are incorporated by reference into this Background section: U.S. Pat. Nos. 330,152; 417,124; 429,089; 1,531,757; 5,313,691; 5,711,056; 5,970,588; 6,557,220; 7,0007,353; and 7,070,076.

SUMMARY

Example embodiments according to the present disclosure may include buckles for releasably connecting a first object and a second object. Example buckles may include a base including a first upstanding wall including a first boss extending therefrom and a second upstanding wall including a second boss extending therefrom. A housing may be mounted to a connector. The housing may include a hook section shaped to engage the first boss and the second boss and including a mouth for receiving the first boss and the second boss therethrough. A trigger may be configured to selectively obstruct the mouth. The trigger may include a first leg, a second leg, and one or more actuators operative to move the first leg and the second leg generally towards each other such that the first leg and the second leg may pass between the first boss and the second boss as the first boss and the second boss pass through the mouth.

In an aspect, a buckle for releasably connecting a first object and a second object may include a base associated with a first object, the base including a first upstanding wall including a first boss extending therefrom, and a second upstanding wall including a second boss extending therefrom, where the first boss and the second boss generally oppose each other and extend generally towards each other between the first wall and the second wall; a connector associated with a second object; a housing mounted to the connector, the housing including a hook section shaped to engage the first boss and the second boss, the hook section including mouth for receiving the first boss and the second boss therethrough, and a trigger mounted to the housing and configured to selectively obstruct the mouth, the trigger including a first leg corresponding to the first boss, a second leg corresponding to the second boss, and at least one actuator operative to move the first leg and the second leg generally towards each other such that the first leg and the second leg may pass between the first boss and the second boss as the first boss and the second boss pass through the mouth.

In a detailed embodiment, the base may include a mounting plate from which the first wall and the second wall extend, the base being mounted to the first object. In a detailed embodiment, the first boss and the second boss may be substantially cylindrical. In a detailed embodiment, when the hook section is engaged with the first boss and the second boss, the housing may be pivotable with respect to the base about an axis which may extend through the first boss and the second boss. In a detailed embodiment, the trigger may include a head section and/or the first leg and the second leg may be joined at the head section.

In a detailed embodiment, the first leg may include a first end arranged to engage the first boss, the first end including a first sloped surface and the second leg may include a second end arranged to engage the second boss, the second end including a second sloped surface. Contact between the first boss and the first sloped surface and contact between the second boss and the second sloped surface may be operative to move the first end and the second end inward between the first boss and the second boss as the first boss and the second boss pass through the mouth.

In a detailed embodiment, the at least one actuator may include a first actuator extending from the first leg and a second actuator extending from the second leg. In a detailed embodiment, the first actuator may include a first button and the second actuator includes a second button. In a detailed embodiment, the connector may be mounted to the housing by a swivel connection. In a detailed embodiment, the connector may include at least one bar and at least one slot, and the second object may include a strap engaging the bar and the slot.

In an aspect, a buckle for releasably connecting a first object and a second object may include a hook section having a substantially J-shaped cross section and including a mouth, the hook section being associated with a first object; a trigger including two legs, the two legs partially obstructing the mouth, the two legs being movable within the mouth while still partially obstructing the mouth; a pair of bosses receivable within the hook section, the pair of bosses being associated with a second object; and an actuator associated with each of the two legs, the actuators being operative to move the two legs to selectively allow or obstruct passage of the pair of bosses through the mouth.

In a detailed embodiment, a buckle may include a housing attached to the hook section, the housing including a cavity receiving at least a portion of the trigger. In a detailed embodiment, the hook section may be integrally formed with at least a portion of the housing. In a detailed embodiment, a buckle may include a connector mounted to the housing generally opposite from the hook section, the connector configured for attachment to the first object.

In a detailed embodiment, the pair of bosses may be provided on a base, the base including a pair of upstanding walls, each of the pair of bosses being disposed on a respective one of the pair of upstanding walls. In a detailed embodiment, the pair of bosses may be generally opposed and extend generally towards each other between the pair of upstanding walls.

In an aspect, an infant carrier may include a shoulder strap; a support panel; and a releasably connectable buckle interposing the shoulder strap and the support panel, the buckle comprising a base including a pair of opposed bosses extending inwardly between a pair of upstanding walls, a housing including a hook section configured to releasably couple with the opposed bosses, the hook section including a mouth sized to receive the opposed bosses therethrough, a trigger including two legs extending into and selectively at least partially obstructing the mouth, at least one actuator operative to move the two legs towards each other such that they fit between the opposed bosses, and a connector mounted to the housing. The base may be mounted to one of the shoulder strap and the support panel and/or the connector may be mounted to the other of the shoulder strap and the support panel.

In a detailed embodiment, the housing may be pivotable relative to the base about an axis extending generally through the opposed bosses. In a detailed embodiment, each of the legs may include an end arranged to engage a respective one of the opposed bosses, each end including a sloped surface. In a detailed embodiment, contact between the bosses and the respective sloped surfaces may be operative to move the ends inward between the opposed bosses as the opposed bosses pass through the mouth.

BRIEF DESCRIPTION OF THE DRAWINGS

The detailed description refers to the following figures in which.

DETAILED DESCRIPTION

The present disclosure is directed to, inter alia, buckles for releasably connecting two objects. For example, buckles according to the present disclosure may be used on infant carriers for releasably connecting components, such as releasably connecting a support panel to a shoulder strap.

Figure 1:
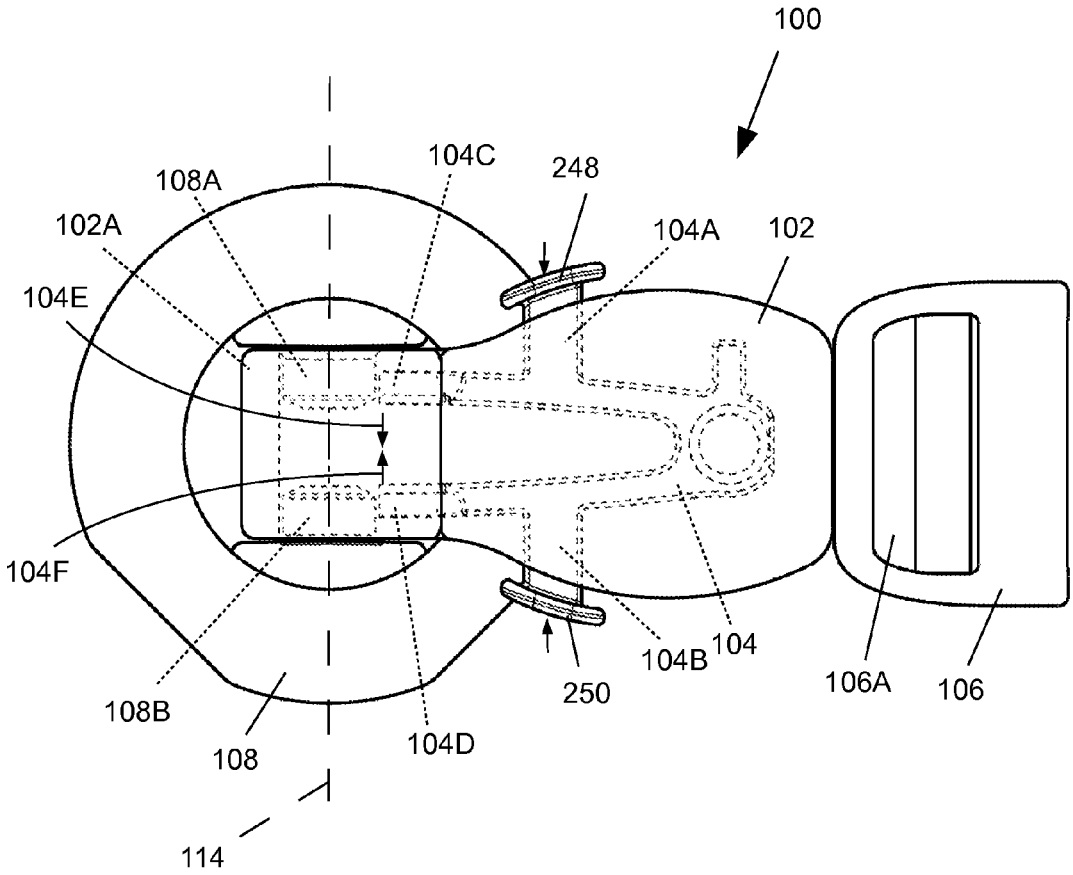
FIG. 1 is a plan view of an example buckle.
Figure 2:
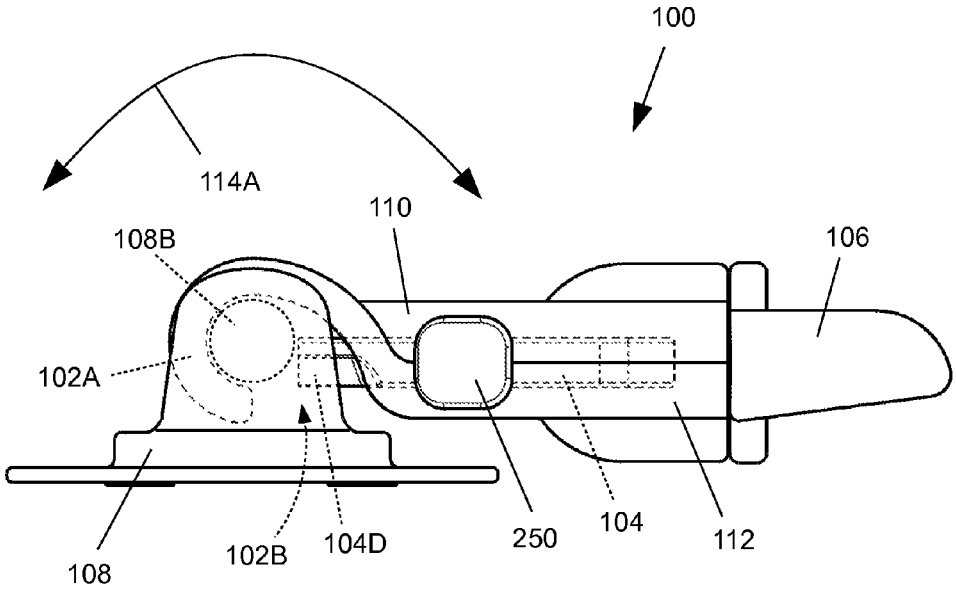
FIG. 2 is an elevation view of an example buckle.

FIGS. 1 and 2 illustrate an example buckle 100, which may include a housing 102, a trigger 104, a connector 106, and/or a base 108. Housing 102 may include a hook section 102A, which may releasably engage one or more bosses 108A, 108B on base 108 and/or which may have a substantially J-shaped cross section. Housing 102 may be pivotable with respect to base about a pivot axis 114, which may extend through bosses 108A, 108B of base 108, generally as indicated by arrow 114A.

Hook section 102A of housing 102 may include a mouth 1028, which may be at least partially obstructed by one or more ends 104C, 104D of trigger 104. Trigger 104 may include one or more actuators 104A, 104B configured to move one or more interface portions, e.g., ends 104C, 104D, such that hook section 102A may be disengaged from bosses 108A, 108B. For example, buttons 248, 250 may be squeezed inwardly towards housing 102, which may cause ends 104C, 104D to move inwardly as indicated by arrows 104E, 104F. This may allow housing 102 to translate relative to base 108 such that bosses 108A, 108B pass through mouth 102B and/or ends 104C, 104D pass between bosses 108A, 108B, thereby disengaging hook section 102A from bosses 108A, 108B.

In some example embodiments, housing 102 may include an upper housing 110 and/or a lower housing 112. Connector 106 may be rotatably coupled to housing 102, such as by being captured between upper housing 110 and lower housing 112. Connector 106 may include one or more slots 106A, which may receive straps, webbing, or the like.

Figure 3:
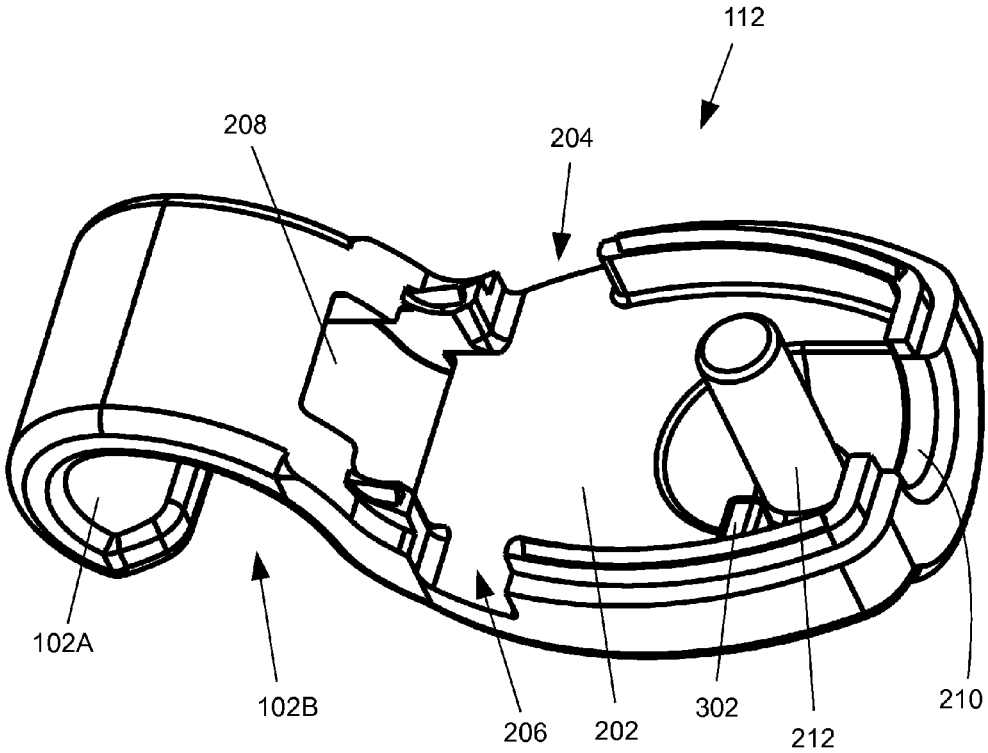
FIG. 3 is a perspective view of an example lower housing.

FIG. 3 is a perspective view of an example lower housing 112, which may include a cavity 202 (which may receive at least a portion of trigger 104) and/or hook section 102A. In some example embodiments, hook section 102A may be formed integrally with lower housing 112.

Lower housing 112 may include various openings, such as one or more actuator openings 204, 206 (which may receive actuators 104A, 104B), a trigger opening 208 (through which trigger 104 may extend between actuators 104A, 104B and ends 104C, 104D), and/or a connector mounting opening 210 (which may receive a portion of connector 106). Some example lower housings 112 may include one or more features configured to engage trigger 104, such as post 212 (which may extend through trigger 104) and/or tab 302 (which may prevent installation of trigger 104 in an inverted orientation). In some example embodiments, connector mounting opening 210 may include a portion of a generally circular shape.

Figure 4A:
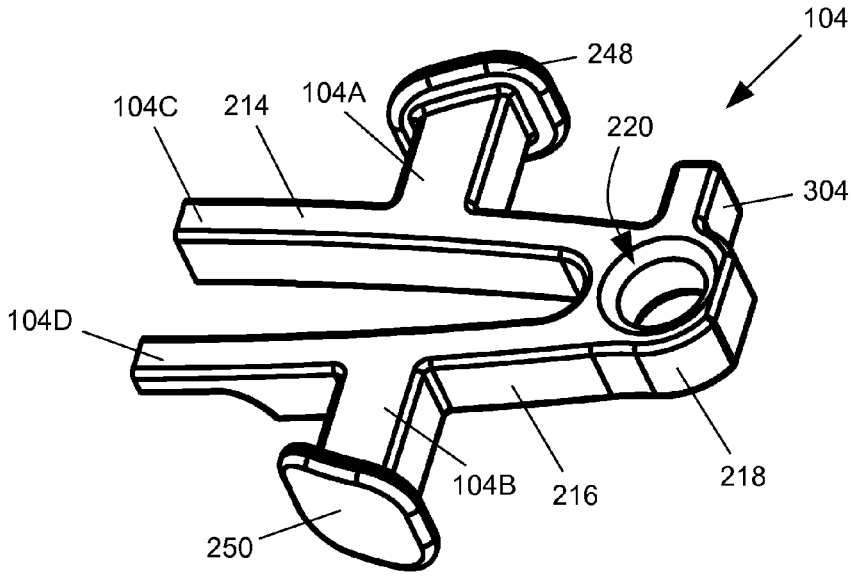
FIG. 4A is a perspective view of an example trigger.
Figure 4B:
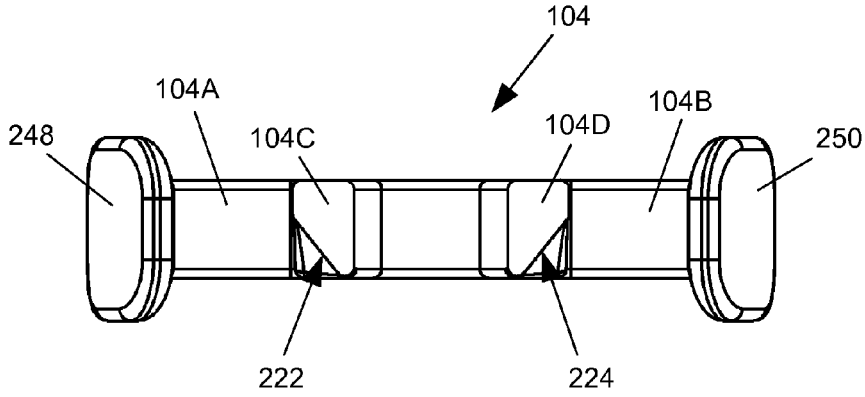
FIG. 4B is an end view of an example trigger.

FIG. 4A is a perspective view of an example trigger 104, and FIG. 4B is an end view of an example trigger 104. Trigger 104 may include one or more legs 214, 216, which may be joined at a head section 218. Legs 214, 216 may be flexible (e.g., elastically deformable) and/or pivotable relative to one another such that they may be moved inwardly towards each other when inwardly directed forces are applied to actuators 104A, 104B. Head section 218 may include a through hole 220 for receiving post 212 of lower housing 112.

Ends 104C, 104D may be shaped, such as to allow engagement of hook section 102A with bosses 108A, 108B without using actuators 104A, 104B to move ends 104C, 104D inwardly. For example, ends 104C, 104D may include sloped surfaces 222, 224, which may engage bosses 108A, 108B as mouth 102B is placed over bosses 108A, 108B. Pressing sloped surfaces 222, 224 on bosses 108A, 108B may cause ends 104C, 104D to move inwardly (by flexing and/or pivoting legs 214, 216), such that hook section 102A may engage bosses 108A, 108B. Once ends 104C, 104D have passed bosses 108A, 108B, legs 214, 216 may spring outwards, thereby allowing ends 104C, 104D to maintain bosses 108A, 108B engaged with hook section 102A.

Some example embodiments may include one or more features arranged to ensure that trigger 104 is installed in a desired orientation within housing 102. For example, a lateral tab 304 may contact tab 302 of lower housing 112 if trigger 104 is installed in an inverted orientation (e.g., with sloped surfaces 222, 224 facing the closed portion of hook section 102A instead of mouth 102B). This contact may prevent installation of trigger 104 in the inverted orientation.

Figure 5:
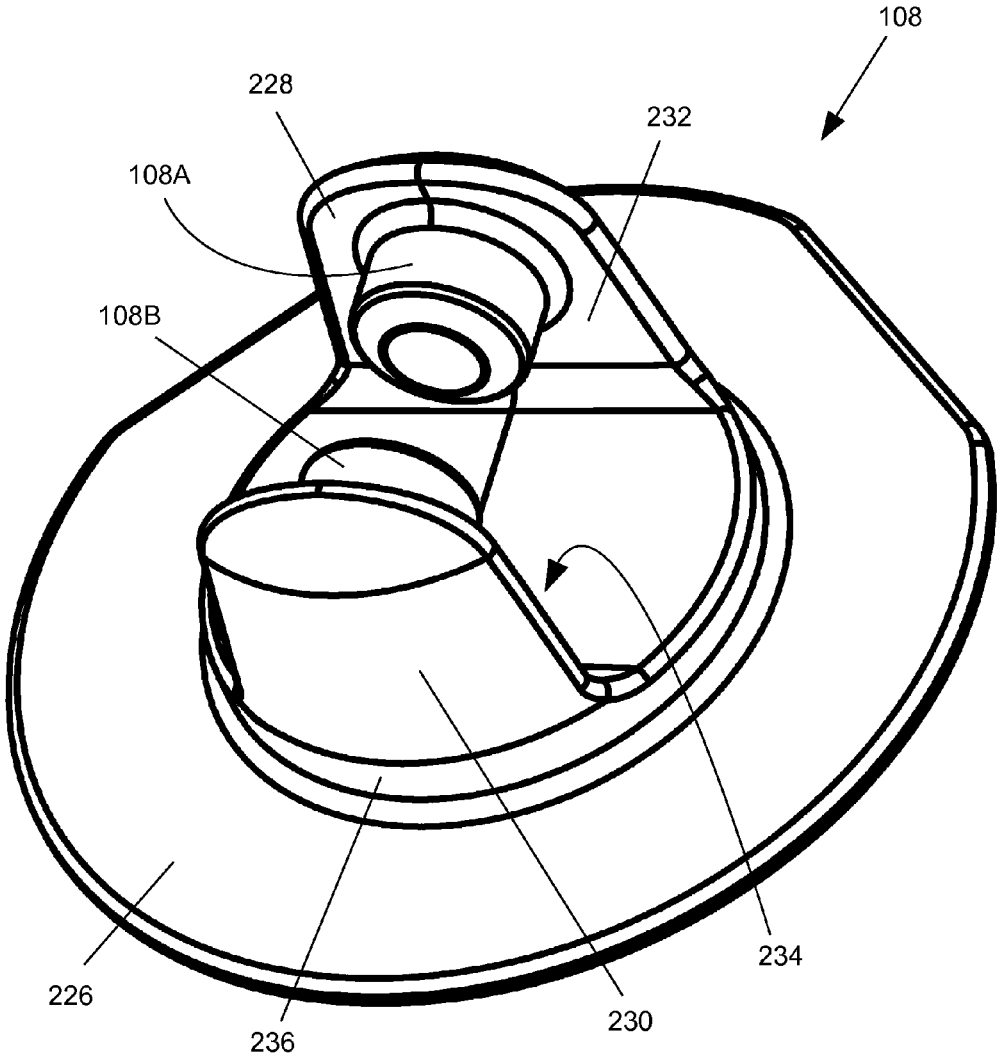
FIG. 5 is a perspective view of an example base.

FIG. 5 is a perspective view of an example base 108, which may include a mounting plate 226 and/or one or more upstanding walls 228, 230. Bosses 108A, 108B may be provided on inwardly facing surfaces 232, 234 of walls 228, 230. In some example embodiments, a pedestal 236 may interpose walls 228, 230 and mounting plate 226. In some example embodiments, bosses 108A, 108B may be generally cylindrical and/or may include tapered inward ends.

Figure 6:
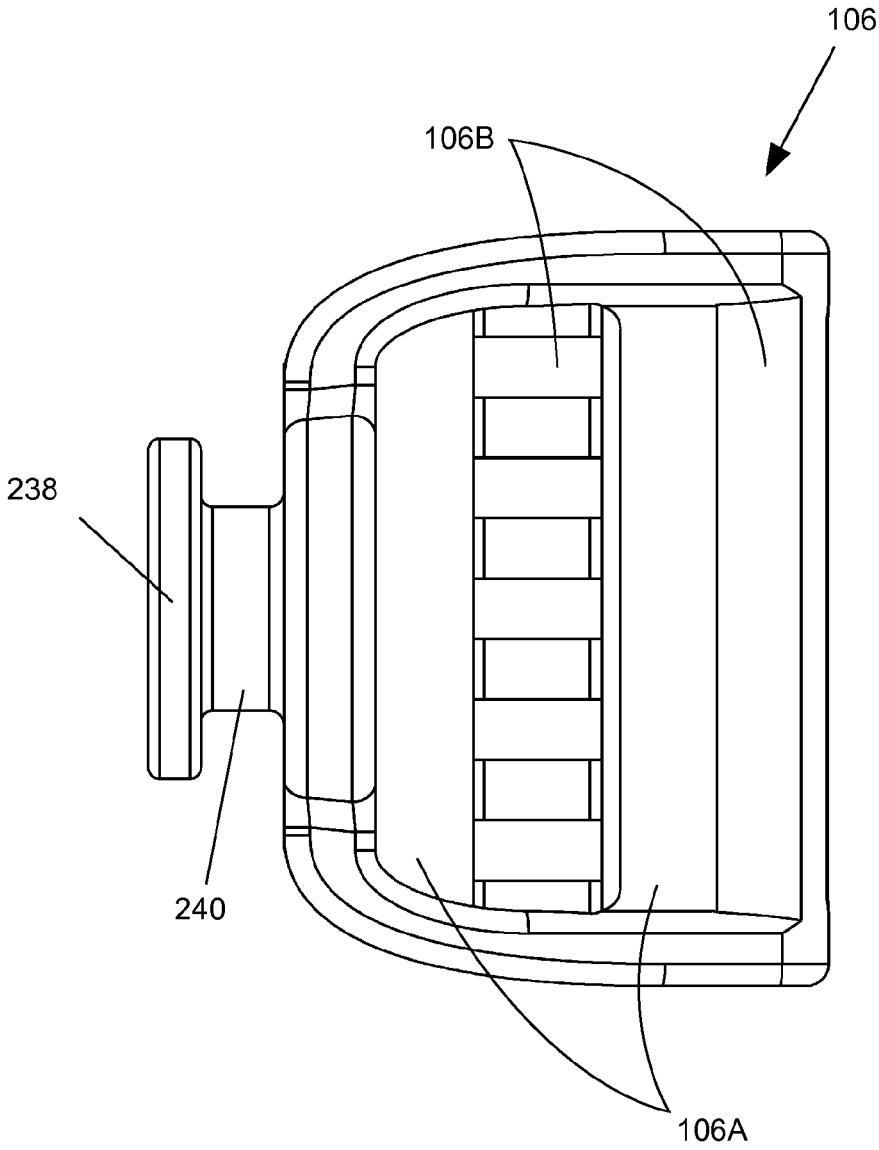
FIG. 6 is a plan view of an example connector.

FIG. 6 is a plan view of an example connector 106, which may include one or more one or more slots 106A and/or bars 106B, which may receive straps, webbing, or the like. Connector 106 may include a longitudinally extending coupling 238 for connecting to housing 102. Coupling 238 may include a narrowed neck 240. In some example embodiments, coupling 238 and/or neck 240 may be generally cylindrical such that connector 106 may be rotatable with respect to housing 102. Such an interface may be referred to as a swivel connection.

Figure 7:
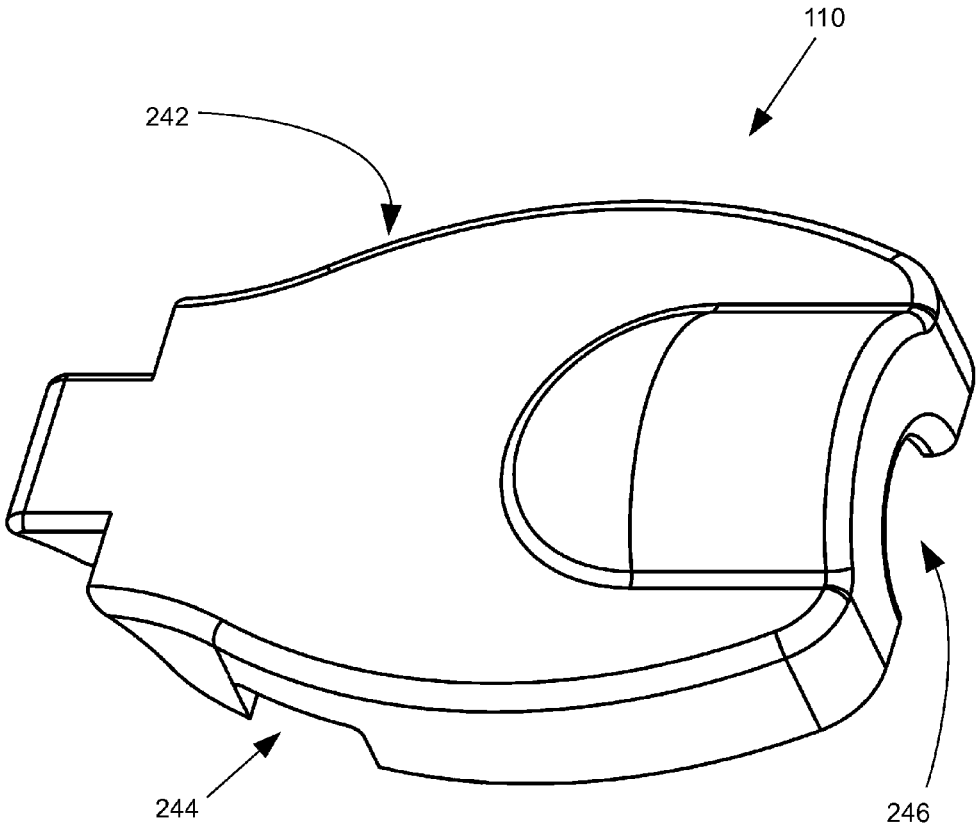
FIG. 7 is a perspective view of an example upper housing.

FIG. 7 is a perspective view of an example upper housing 110. Upper housing may include various openings, such as one or more actuator openings 242, 244 and/or a connector mounting opening 246. In some example embodiments, connector mounting opening 246 may include a portion of a generally circular shape.

Figure 8:
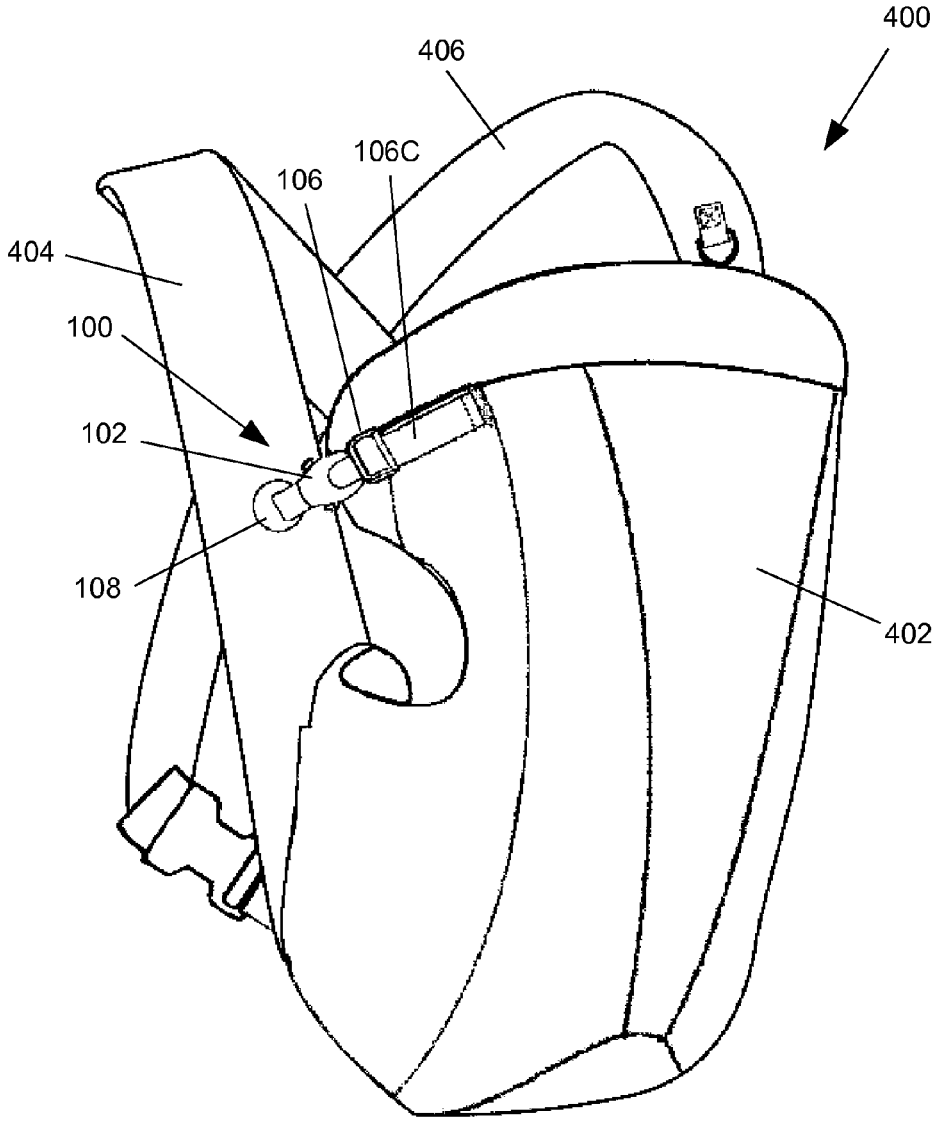
FIG. 8 is a perspective view of an example infant carrier including an example buckle; all in accordance with at least some aspects of the present disclosure.

FIG. 8 is a perspective view of an example infant carrier 400, which may include one or more buckles 100. Infant carrier 400 may include a support panel 402, which may be configured to receive and/or support an infant (such as adjacent a caregiver's torso) and/or one or more shoulder straps 404, 406, which may be configured to extend generally over at least one of the caregiver's shoulders. In some example embodiments, buckle 100 may be arranged to releasably connect support panel 402 to shoulder strap 404. For example, base 108 may be mounted to shoulder strap 404 (e.g., a first object) and/or connector 106 may engage a strap 106C mounted to support panel 402 (e.g., a second object). It is within the scope of the disclosure to reverse the arrangement (e.g., base 108 may be mounted to support panel 402 and/or connector may be coupled to shoulder strap 404), to employ a similar buckle 100 arrangement to connect support panel 402 to shoulder strap 406, and/or to employ more than one buckle 100 to connect support panel 402 to either of shoulder straps 404, 406.

Example buckles 100 and components thereof according to the present disclosure may be constructed, for example, from molded plastic. Various components (e.g., upper housing 110 and lower housing 112) may be joined using techniques known in the art, such as ultrasonic welding.

Although example buckles 100 have been described herein in connection with infant carriers, the present disclosure contemplates that example buckles 100 may be useful in other applications. For example, example buckles 100 according to the present disclosure may be useful where it is desired to releasably connect a section of webbing to a fabric component.

An example method of attaching a buckle 100 according to the present disclosure may include aligning bosses 108A, 108B of base 108 with mouth 102B of hook section 102A. Bosses 108A, 108B may be moved through mouth 102B and into hook section 102A, which may involve bosses 108A, 108B contacting sloped surfaces 222, 224, which may cause legs 214, 216 to move inwards. Ends 104C, 104D may pass between bosses 108A, 108B as bosses 108A, 108B move through mouth 102B and into hook section 102A. Once bosses 108A, 108B are clear of legs 214, 216, ends 104C, 104D may spring outwards, thereby acting to retain bosses 108A, 108B within hook section 102A.

An example method of releasing a buckle 100 according to the present disclosure may include squeezing buttons 248, 250, which may move ends 104C, 104D of legs 214, 216 inward with respect to bosses 108A, 108B. Hook section 102A may be disengaged from bosses 108A, 108B by sliding bosses 108A, 108B through mouth 102B with ends 104C, 104D between bosses 108A, 108B.

While exemplary embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages may exist even though they may not have been explicitly discussed herein.

What is claimed is:

1. A buckle for releasably connecting a first object and a second object, the buckle comprising:

a hook section having a substantially J-shaped cross section and including a mouth, the hook section being associated with a first object;

a trigger including two legs, the two legs partially obstructing the mouth, the two legs being movable within the mouth while still partially obstructing the mouth;

a pair of bosses receivable within the hook section, the pair of bosses being associated with a second object; and an actuator associated with each of the two legs, the actuators being operative to move the two legs to selectively allow or obstruct passage of the pair of bosses through the mouth.

2. The buckle of claim 1, further comprising a housing attached to the hook section, the housing including a cavity receiving at least a portion of the trigger.

3. The buckle of claim 2, wherein the hook section is integrally formed with at least a portion of the housing.

4. The buckle of claim 2, further comprising a connector mounted to the housing generally opposite from the hook section, the connector configured for attachment to the first object.

5. The buckle of claim 1, wherein the pair of bosses are provided on a base, the base including a pair of upstanding walls, each of the pair of bosses being disposed on a respective one of the pair of upstanding walls.

6. The buckle of claim 5, wherein the pair of bosses are generally opposed and extend generally towards each other between the pair of upstanding walls.

7. A buckle for releasably connecting a first object and a second object, the buckle comprising:

a base associated with a first object, the base including a first upstanding wall including a first boss extending therefrom, and a second upstanding wall including a second boss extending therefrom, wherein the first boss and the second boss generally oppose each other and extend generally towards each other between the first wall and the second wall;

a connector associated with a second object;

a housing mounted to the connector, the housing including a hook section shaped to engage the first boss and the second boss, the hook section including mouth for receiving the first boss and the second boss therethrough, and a trigger mounted to the housing and configured to selectively obstruct the mouth, the trigger including a first leg corresponding to the first boss, a second leg corresponding to the second boss, and at least one actuator operative to move the first leg and the second leg generally towards each other such that the first leg and the second leg may pass between the first boss and the second boss as the first boss and the second boss pass through the mouth.

8. The buckle of claim 7, wherein the base includes a mounting plate from which the first wall and the second wall extend, the base being mounted to the first object.

9. The buckle of claim 7, wherein the first boss and the second boss are substantially cylindrical.

10. The buckle of claim 7, wherein, when the hook section is engaged with the first boss and the second boss, the housing is pivotable with respect to the base about an axis extending through the first boss and the second boss.

11. The buckle of claim 7, wherein the trigger includes a head section; and wherein the first leg and the second leg are joined at the head section.

12. The buckle of claim 7, wherein the first leg includes a first end arranged to engage the first boss, the first end including a first sloped surface;

wherein the second leg includes a second end arranged to engage the second boss, the second end including a second sloped surface;

wherein contact between the first boss and the first sloped surface and contact between the second boss and the second sloped surface are operative to move the first end and the second end inward between the first boss and the second boss as the first boss and the second boss pass through the mouth.

13. The buckle of claim 7, wherein the at least one actuator includes a first actuator extending from the first leg and a second actuator extending from the second leg.

14. The buckle of claim 7, wherein the first actuator includes a first button and the second actuator includes a second button.

15. The buckle of claim 7, wherein the connector is mounted to the housing by a swivel connection.

16. The buckle of claim 7, wherein the connector includes at least one bar and at least one slot; and wherein the second object includes a strap engaging the bar and the slot.

17. An infant carrier comprising:

a shoulder strap;

a support panel; and a releasably connectable buckle interposing the shoulder strap and the support panel, the buckle comprising a base including a pair of opposed bosses extending inwardly between a pair of upstanding walls, a housing including a hook section configured to releasably couple with the opposed bosses, the hook section including a mouth sized to receive the opposed bosses therethrough, a trigger including two legs extending into and selectively at least partially obstructing the mouth, at least one actuator operative to move the two legs towards each other such that they fit between the opposed bosses, and a connector mounted to the housing;

wherein the base is mounted to one of the shoulder strap and the support panel; and wherein the connector is mounted to the other of the shoulder strap and the support panel.

18. The infant carrier of claim 17, wherein the housing is pivotable relative to the base about an axis extending generally through the opposed bosses.

19. The infant carrier of claim 17, wherein each of the legs includes an end arranged to engage a respective one of the opposed bosses, each end including a sloped surface; and wherein contact between the bosses and the respective sloped surfaces is operative to move the ends inward between the opposed bosses as the opposed bosses pass through the mouth.

* * * * *